US005706729A

United States Patent [19]

Tai et al.

[11] Patent Number: 5,706,729

[45] Date of Patent: Jan. 13, 1998

[54] LABEL MAKING MACHINE

[75] Inventors: Feng-Yi Tai, Taipei Hsien; Jung-Chin Chang, Taipei, both of Taiwan

[73] Assignee: Godex International Co., Ltd., Taipei Hsien, Taiwan

[21] Appl. No.: 612,132

[22] Filed: Mar. 7, 1996

[51] Int. Cl.[6] ..... B41F 1/08

[52] U.S. Cl. ..... 101/288; 400/613

[58] Field of Search ..... 101/288, 228; 400/613, 613.1, 120.01, 614.1, 615, 618, 611, 614; 226/190

[56] References Cited

U.S. PATENT DOCUMENTS

| | | | |
|---|---|---|---|
| 4,746,932 | 5/1988 | Sato | 101/288 |
| 5,033,881 | 7/1991 | Koike | 101/288 |
| 5,497,701 | 3/1996 | Uland | 101/288 |

FOREIGN PATENT DOCUMENTS

| | | | |
|---|---|---|---|
| 0266276 | 11/1986 | Japan | 101/288 |

*Primary Examiner*—Christopher A. Bennett

[57] ABSTRACT

The present invention is to offer a label making machine and particularly related to a label making machine consisting of an outer housing, an inner base, a making device and a back cover, wherein the inner base is a rectangular housing body with one each indentation on the left and right sides thereof to contain a circuit board, a making device is disposed on the top of the inner base, and a small reel of label paper can be disposed inside the inner base, such a structural design can make the production modulization and test more convenient; and through opening the back cover pivotally installed on the back of the outer housing and assembling two support arms with the back cover, a larger label paper reel can be disposed on these support arms for proceeding with the required operating.

4 Claims, 6 Drawing Sheets

LABEL MAKING MACHINE

BACKGROUND OF THE INVENTION

Field of the Invention

The present invention is related to a label making machine which can modulize the production thereof, make the test more convenient and be very simply suitable for the use of large and small label paper reels.

Particularly for making the manufacturing date and price of the product, or marking the nomenclature, model or other special purpose such as the shop name on the outer packing of product, normally the marked purpose is written with a pen on a self-adhesive label paper which is then pasted on the product. However, if the product items are numerous or there are many a product of a unitary item, the foregoing manual writing is obviously uneconomical.

For only marking the manufacturing date or price, a small stamp on the market can stamp simple Arabic figures on the label paper reel to solve the problem of simple marking. However, for stamping English, special symbols or even more complex styles of Chinese characters (e.g. stamping shop name on the label paper), the Chinese characters thereon have to be made by the printing shop, and if the requirement is not too many, it is uneconomical. Therefore, the label making machine for making characters, symbols, mumerals, etc. on the label paper on the market is available for the users' free choice and use.

Nevertheless, so far as the conventional label making machine is concerned, the circuit control board, making device and paper supply device are wholly and directly installed in the housing of the making machine, leading to a mess of wiring, impossible production modulization, very inconvenient test and maintenance and repair, and an additional label paper supply device when using a large roll of label paper reel; namely, as shown in FIG. 6, when making a larger roll of label papar reel, a support(b) is disposed behind the label marking machine(a), a whole label paper reel(c) is disposed on the support(b), the label paper(c1) is disposed to pass through the label mains machine(a), and then to proceed with the operation of making label. However, so far as the conventional label paper supply device of making machine is concerned, the label mating machine(a) and the support(b) of label paper reel(c) are separate members; since the support(b) is optionally disposed behind the label making machine(a), when making label on the label paper(c1), namemly, when the making machine is in operation of making, the support(b) tends to fall down to affect the label making operation; in addition, the label making machine(a) and the support(b) are independent of each other without an integral design, the installation thereof for using and the removal and storage thereof when not in use are extremely inconvenient.

SUMMARY OF THE INVENTION

The present invention is to offer a label making machine and particularly related to a label making machine consisting of an outer housing, an inner base, a making device and a back cover, wherein the inner base is a rectangular housing body of which the left and right sides are indentations for installing circuit boards. The making device is installed on the top of the inner base , and a smaller roll of label paper can be installed in the inner base, such a design makes the production modulization and test more convenient. The back cover is on the back of the outer housing and can be turned open for assembling two support arms with the back cover so that a larger roll of label paper can be disposed on these two support arms for use.

Therefofre, the object of the present invention is to offer a label making machine wherein an inner base is a rectangular housing body and installed in an outer housing, the indentations on the left and right sides of the inner base are designed to install circuit boards, one each revolving shaft guide way is in a suitable position on the left and right sides inside the inner base, a recess is in a suitable position on the guide way, a revolving shaft is disposed in the recess, a label paper reel with a small diameter is installed on the revolving shaft, and a making device is installed in a suitable position on the top of the inner base for a neat wiring, modulized production and more convenient maintenance, repair and test so as to upgrade the efficiency of production.

Another object of the present invention is to offer a label making machine, wherein a back cover is pivotally installed on the back of the outer housing, two sets of opposite catches are in the suitable positions on the back cover, To turn open the back cover in a horizontal state, to catch two support arms uprightly between the two sets of catches on the back cover so as to install these two support arms uprightly on the back cover, to dispose the revolving shaft on the support arms, and to install a label paper reel with larger diameter on the revolving shaft so as to offer a more eleastic method of installing the label paper reel.

Still another object of the present invention is to offer a label making machine wherein a back cover is pivotally installed on the back of the outer housing, two convex stops are in the suittable positions inside the back cover, two convex catches opposite to the stops are in the suittable positions inside the back cover, two support arms are caught between the stops and the catches respectively, the stops are in the recesses on the support arms, the two opposite catches catch the two sides of the support arms, so that the support arms, if not in use, can be kept inside the back cover in favor of storage without occupying the limited space.

DETAILED DESCRIPTION OF THE PREFERRED EMBODIMENTS

Figure 1:
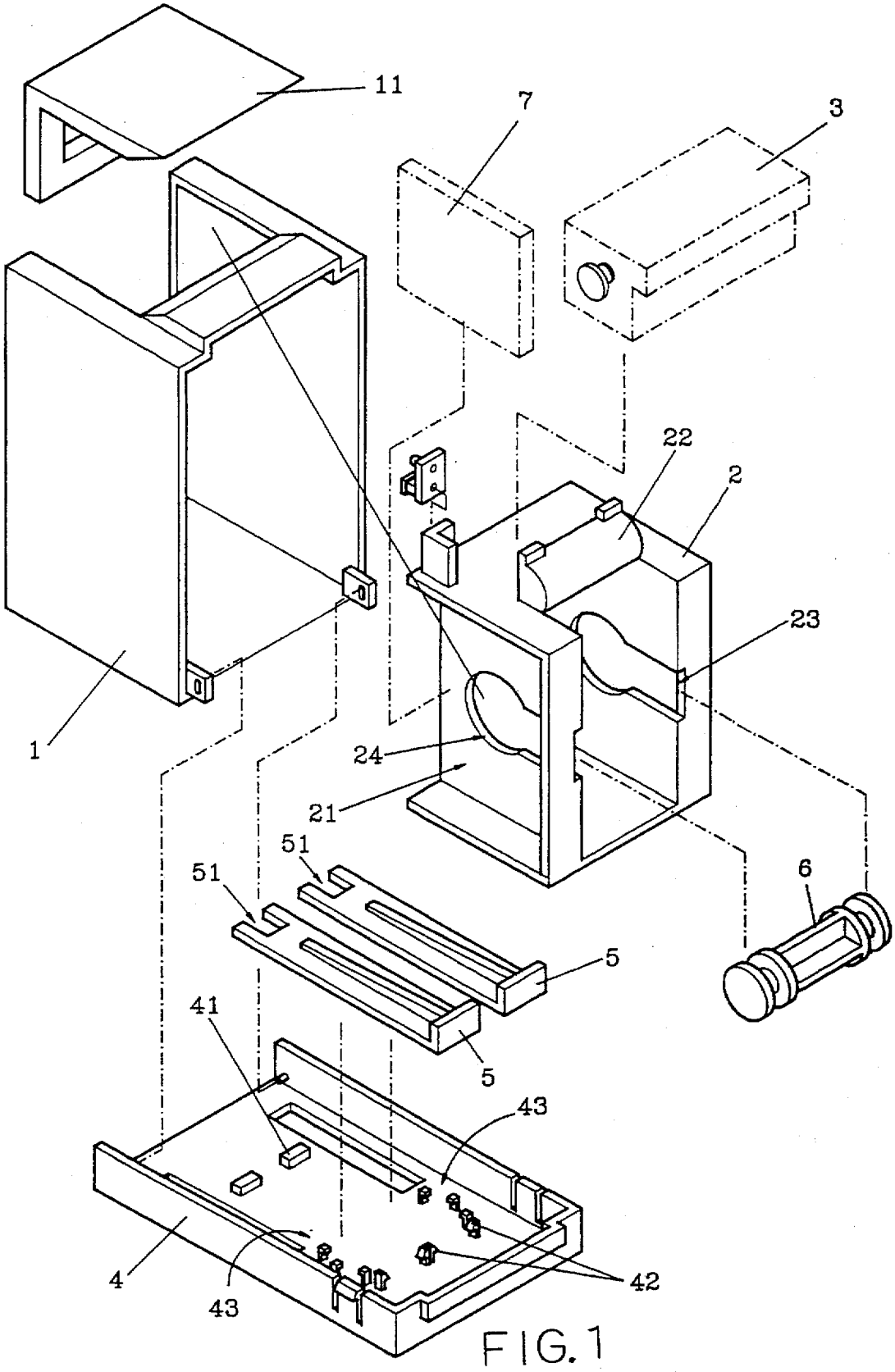
FIG. 1 is an elevation breakdown view of the present invention.

As shown in FIG. 1, the label making machine according to the present invention essentially consists of an outer housing 1, an inner base 2, a making device 3, a back cover 4, two support arms 5 and a revolving shaft 6 of which the detailed structure and relative spatial positions are described respectively hereinbelow :

An outer housing 1 has an upper cover 11 in front of the upper end thereof.

An inner base 2 is a rectangular housing body inside the outer housing 1, has one each board containing space 21 as an indentation on the left and right sides of inner base 2 for installing a circuit board 7, an embowed guide seat 22 on the top of the inner base 2 is designed to smoothly guide the label paper into the making device 3; one each revloving shaft guide way 23 is in a suitable position on the left and right sides inside the inner base 2, and one each recess 24 is in a suitable position on each one of these two revolving shaft guide way 23.

A making device 3 is in a suitable position at the top of the inner base 2.

A back cover 4 is pivotally connected to the lower end of the back of the outer housing 1, two convex stops 41 are in the suitable positions inside the back cover 4, two catches 42 oppsite to the stops 41 are in the suitable positions inside the back cover 4, and two sets of opposite catches 43 are in the suitable positions inside the back cover 4.

Two support arms 5 are L-shaped and with one each recess 51 on the top ends thereof.

A revolving shaft 6 can be disposed in the recess 24 on the inner base 2 or in the recess 51 on the support arm 5.

Figure 2:
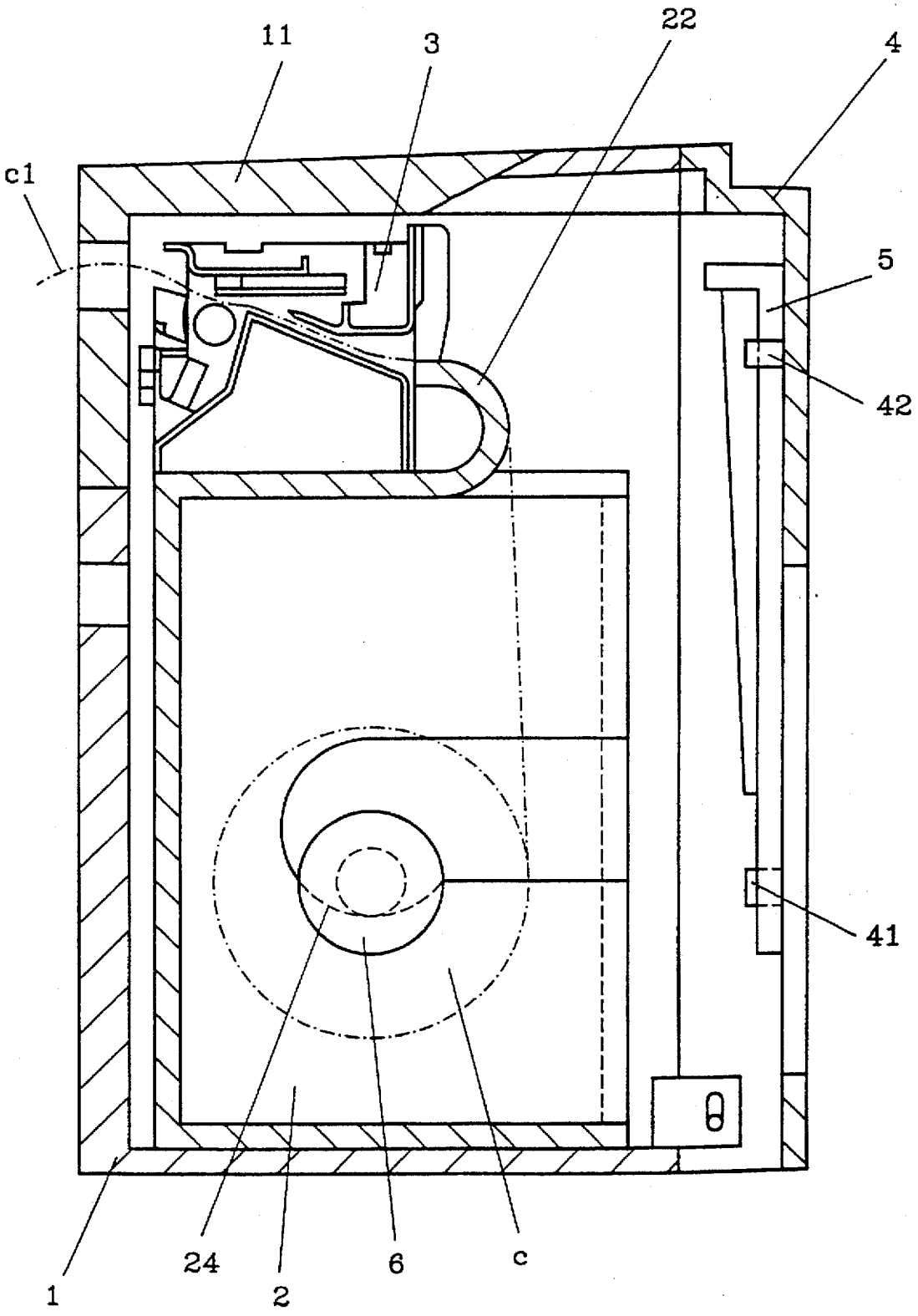
FIG. 2 is a section view of installing the label paper reel inside the labek making machine of the present invention.

Based on the foregoing structure as shown in FIG. 2, a label paper reel(c) with a smaller diameter can be nested on the revolving shaft 6 which is then disposed in the recess 24 on the inner base 2 along the revolving shaft guide way 23 on the inner base 2, and then one end of the label paper(c1) is led into the making device 3 along the embowed guide seat 22 to proceed with the label making operation. Since a label paper reel(c) with a smaller diameer is used, if the label paper travel is not smooth or even the label paper reel(c) is caught or can not pass through, to open the upper cover 11 tends to shoot the trouble and lead the label paper(cl) into the making device 3.

Figure 3:
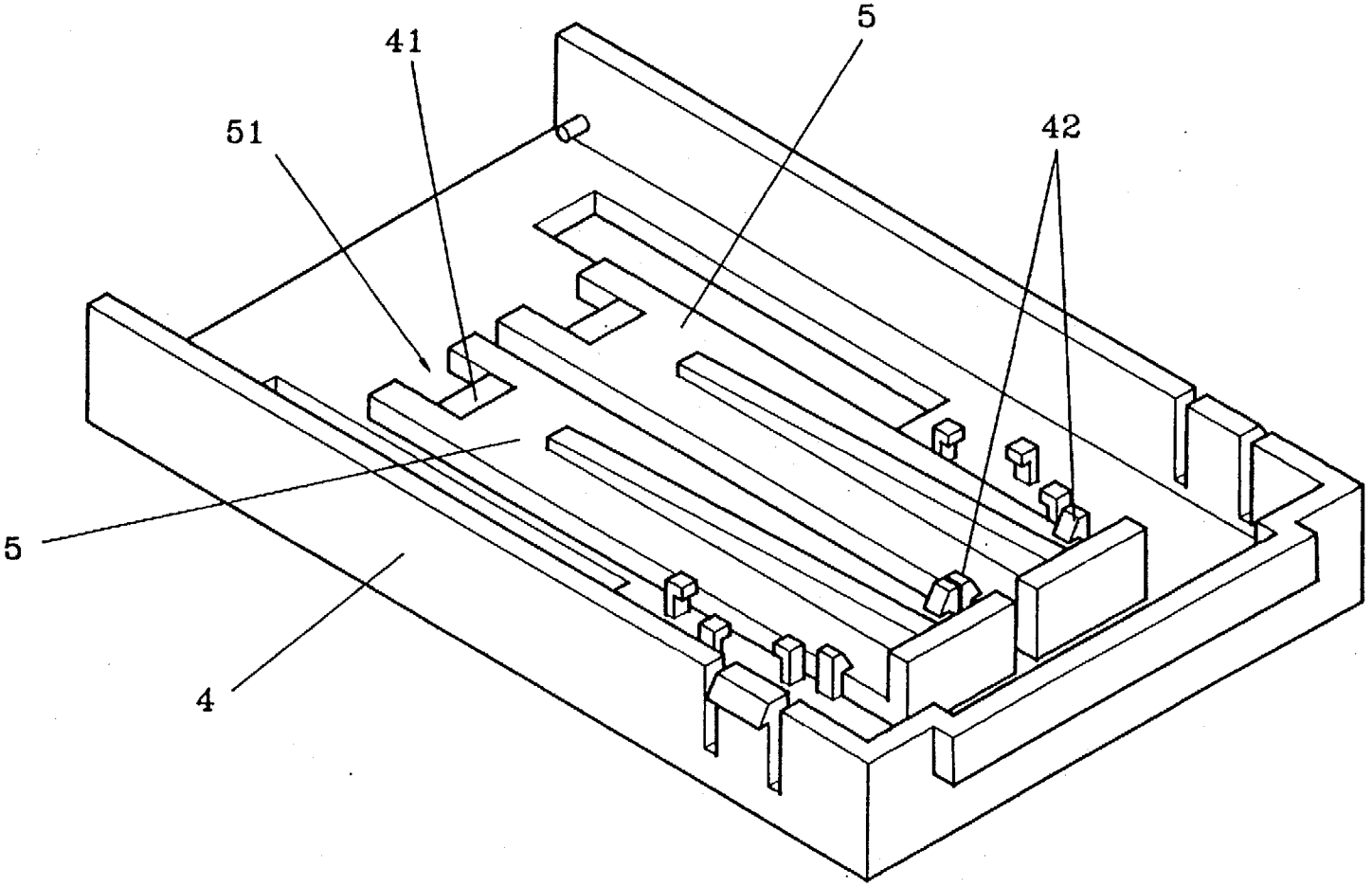
FIG. 3 is an elevational view of storing the support arms inside the back cover of the present invention.

When to use the small label paper reel(c), the support arms 5 may be stored inside the back cover 4 in an idle state. As shown in FIG. 3, to let the recess 51 on the support arm 5 contact against the stop 41, and to let the two opposite catches 42 catch the left and right sides of the support arm 4 , so that the support arm 5 can be caught, fixed and stored between the stop 41 and two opposit catches 42.

Figure 4:
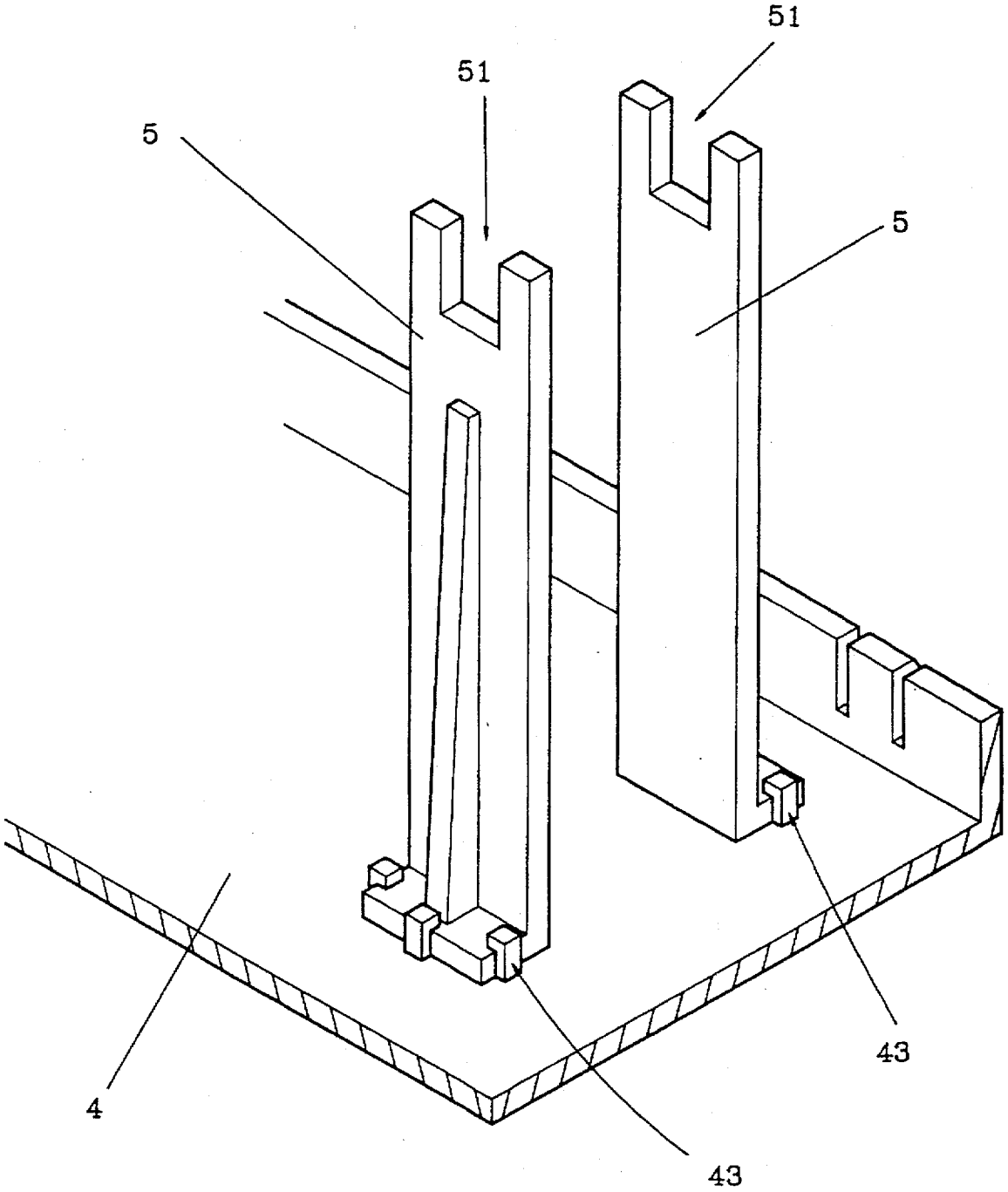
FIG. 4 is an elevation view of installing the support arms on the back cover of the present invention.
Figure 5:
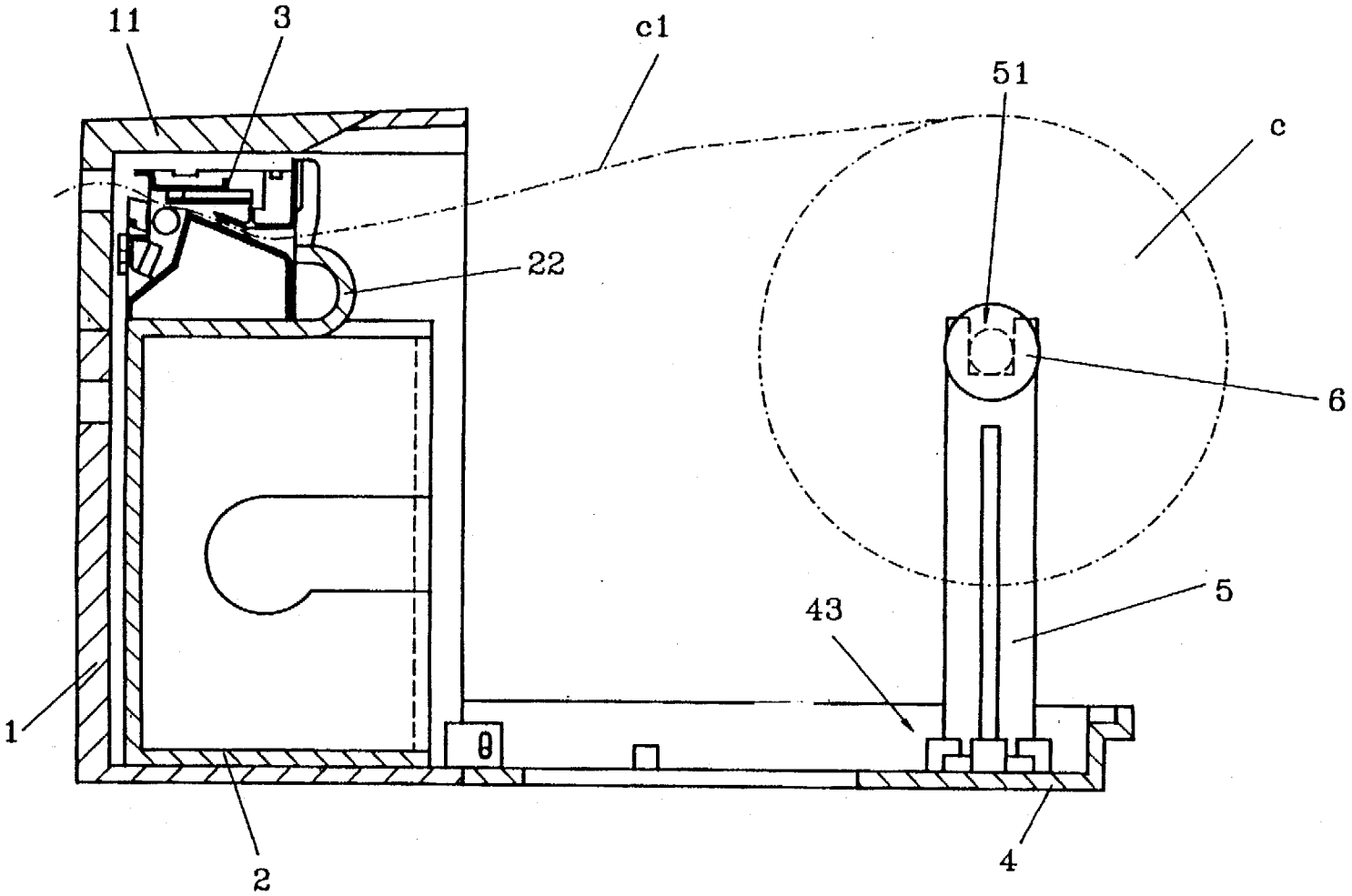
FIG. 5 is a section view of installing the label paper reel outside the labek making machine of the present invention.
Figure 6:
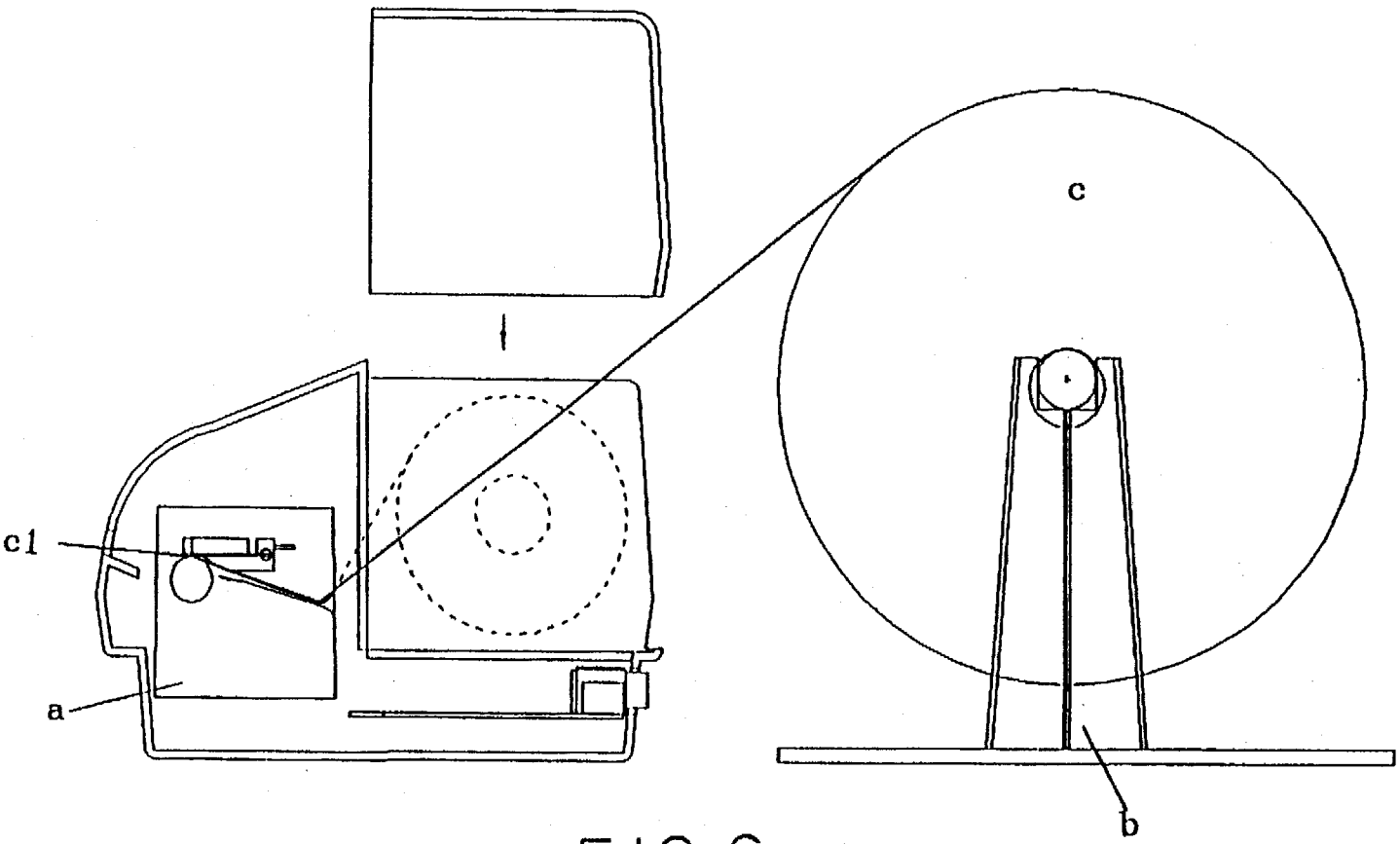
FIG. 6 PRIOR ART
FIG. 6 is an optional view of conventional label making machine.

As shown in FIG. 4, when to use the label paper reel(c) with large diameter, to open the back cover 4 to be in a horizontal state, to remove the two support arms 5 from the back cover 4 and dispose these two support arms 5 upright between the two sets of catches 43 on the back cover 4 so as to dispose the revolving shaft 6 in the recesses 51 on these two support arms 5, and then to install the label paper reel(c) in the foregoing manner so as to proceed with the making operation with the label paper(c1).

Since the devices for supporting the label paper reel(c) and supplying the label paper(c1) and the machine body are integrally designed, the storage and turning open thereof are very convenient without falling down, and this integrity thereof is in favor of continuously stamping the label paper(c1); in addition, depending on the size of label paper reel(c), a suitable manner may be chosen to install the label paper reel(c) and thus rather elastic.

Futhermore, the circuit board 7 for controlling the making device 3 is installed in the board containing spaces 21 on the two sides of the inner base 2, a modulized production is possible in favor of various tests during process, and the outer housing 1 can be opened for maintenance and repair; in addition, the simple structure thereof is in favor of more convenient operation.

What is mentioned above is only a better embodiment of the present invention, so all the changes and modifications according to the present invention as indicated in the claims of the present invention remain within the scope of these claims.

We claim:

1. A label making machine, comprising:

(a) an outer housing;

(b) an inner base including a rectangular body disposed in said outer housing, said inner base including an upper portion and including two side spaces and including a guide way;

(c) a shaft rotatably supported in said guide way for supporting a label paper reel of a label paper;

(d) a making device disposed on said upper portion of said inner base for making label with the label paper;

(e) a back cover pivotally connected to said outer housing;

(f) two support arms each including a lower portion, and each including an upper portion for rotatably supporting said shaft and the label paper; and (g) means for securing said support arms on said back cover uprightly for allowing said upper portions of said support arms to support said shaft and the lavel paper in place.

2. A label making machine according to claim 1, wherein said securing means includes two opposite catches for engaging with said lower portions of said support arms and for securing said support arms uprightly on said back cover and for allowing said upper portion of said support arms to rotatably support said shaft and the label paper.

3. A label making machine according to claim 1, wherein said support arms each includes a recess formed in said upper portion for rotatably supporting said shaft.

4. A label making machine according to claim 3, wherein said back cover includes two stops for engaging with said recesses of said support arms and includes a catch device for engaging with said lower portions of said support arms and for securing said support arms in said back cover.

* * * * *